US008230766B2

(12) United States Patent
Chang

(10) Patent No.: US 8,230,766 B2
(45) Date of Patent: Jul. 31, 2012

(54) WRENCH FOR DIFFERENT-SIZED NUTS

(76) Inventor: Chih-Min Chang, Changhua Hsien (TW)

( * ) Notice: Subject to any disclaimer, the term of this patent is extended or adjusted under 35 U.S.C. 154(b) by 318 days.

(21) Appl. No.: 12/659,864

(22) Filed: Mar. 24, 2010

(65) Prior Publication Data

US 2011/0232424 A1 Sep. 29, 2011

(51) Int. Cl.
*B25B 13/06* (2006.01)
*B25B 13/46* (2006.01)
*B25B 23/16* (2006.01)

(52) U.S. Cl. ..... 81/177.8; 81/177.7; 81/125.1; 81/60

(58) Field of Classification Search ..... 81/177.7, 81/177.8, 177.6, 124.4, 124.5, 125.1, 60
See application file for complete search history.

(56) References Cited

U.S. PATENT DOCUMENTS 648,572 A * 5/1900 Patterson ..... 81/61
2,977,824 A * 4/1961 Theodore ..... 76/114
3,745,860 A * 7/1973 Bennett ..... 81/124.4
5,325,744 A * 7/1994 Horikawa ..... 81/63.2
6,637,299 B1 * 10/2003 Steele ..... 81/124.5
7,182,003 B1 * 2/2007 Hsieh ..... 81/177.6
7,246,544 B1 * 7/2007 Lee et al. ..... 81/177.8
7,281,452 B2 * 10/2007 Chang ..... 81/60
2004/0025646 A1 * 2/2004 Hsien ..... 81/125.1
2009/0241740 A1 * 10/2009 Heagerty ..... 81/63.1
2010/0058896 A1 * 3/2010 Abel et al. ..... 81/60
2010/0294090 A1 * 11/2010 Tsai ..... 81/177.9
2010/0326246 A1 * 12/2010 Chang ..... 81/60

* cited by examiner

*Primary Examiner* — David B Thomas
(74) *Attorney, Agent, or Firm* — Bacon & Thomas, PLLC

(57) ABSTRACT

A wrench for different-sized nuts includes a handle having an opening at a first end thereof and a slot communicated with the opening, an adjustment screw threadedly inserted into the handle and passing through the slot for adjusting a gap of the slot, a first working head rotatably connected with the first end of the handle in such a way that one of first and second mounting portions of the first working head is selectively positionable in the opening of the first end of the handle, and different-sized first and second ratchet sockets rotatably and respectively mounted with the first and second mounting portions. By means of the adjustment screw, the rotationability of the first working head relative to the first end of the handle can be adjusted.

10 Claims, 6 Drawing Sheets

WRENCH FOR DIFFERENT-SIZED NUTS

BACKGROUND OF THE INVENTION

1. Field of the Invention

The present invention relates generally to a wrench, and more specifically to a wrench having different-sized sockets fittable with different-sized nuts.

2. Description of the Related Art

The conventional wrench capable of rotating and changing working end of different sizes usually has four working ends with sockets of different sizes. By means of rotating the working ends, one of the sockets can be selected to serve. Since the conventional wrench of this type is basically equipped with no adjustment device to regulate the rotationability of the working ends, the working ends may freely rotate when the wrench is in use and the revolution speed of the working ends can not be controlled when the working ends are in the process of rotating, causing inconvenience in use.

SUMMARY OF THE INVENTION

It is one objective of the present invention to provide a wrench for different-sized nuts, in which the rotationability of the working head, to which the ratchet sockets are mounted, can be adjusted to a desired extent.

To attain the above-mentioned objective, the present invention provides a wrench for different-sized nuts, which comprises a handle, an adjustment screw, a first working head, and first and second ratchet sockets. The handle has an opening at a first end thereof and a slot communicated with the opening. The adjustment screw is threadedly inserted into the handle and passes through the slot for adjusting a gap of the slot. The first working head has a first mounting portion with a mounting hole and a second portion with a mounting hole. The first working head is rotatably connected with the first end of the handle in such a way that one of the first and second mounting portions of the first working head is selectively positionable in the opening of the first end of the handle. The first ratchet socket is rotatably mounted in the mounting hole of the first mounting portion of the first working head and provided with an adaptor hole. The second ratchet socket is rotatably mounted in the mounting hole of the second mounting portion of the first working head and provided with an adaptor hole which is different in size from the adaptor hole of the first ratchet socket. By means of rotating the first working head, one of the first and second sockets can be selected for being used subject to the size of the nut to be tightened or loosened. Further, by means of the adjustment screw, the rotationability of the first working head can be adjusted to an extent that the first working head can be easily and laborsavingly turned and one of the first and second mounting portions can be precisely positioned in the opening of the first end when one of the sockets is in use.

In a preferred embodiment, the handle is provided with an opening at first and second ends, with each of which a working head holing two ratchet sockets is rotatably connected. In addition, each of ratchet sockets may have a stepped adaptor hole having a relatively larger diameter portion and a relatively smaller diameter portion, and the relatively larger diameter and smaller diameter portions of the adaptor holes of the sockets may be different in size, such that the wrench of the present invention can fit eight different-sized nuts.

The wrench of the present invention may further comprise two positioning units for holding the working heads in position in the openings respectively, and two springing wash for adjusting the rotationabilities of the working heads respectively.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
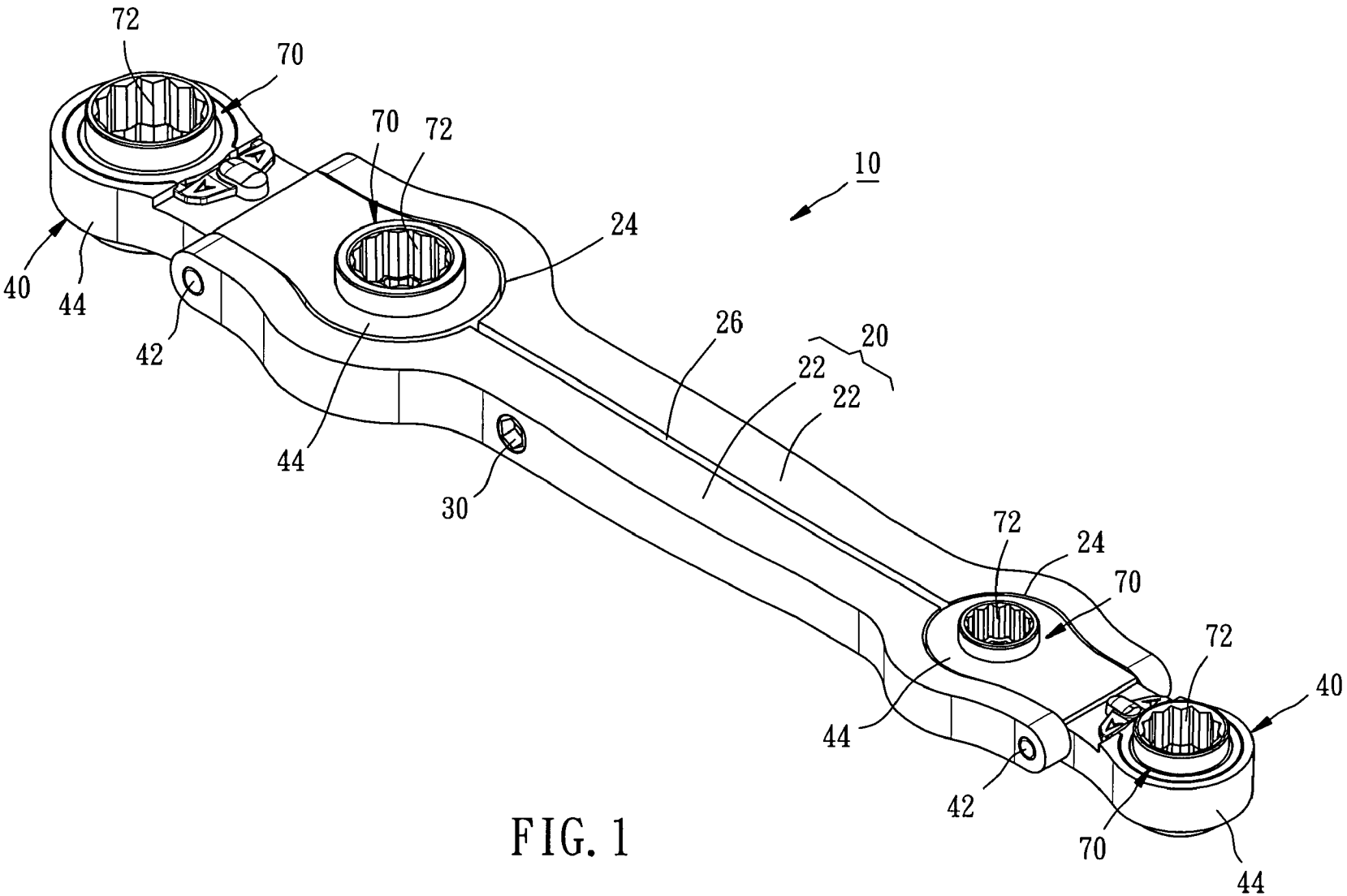
FIG. 1 is a perspective view of a wrench in accordance with a first preferred embodiment of the present invention.
Figure 2:
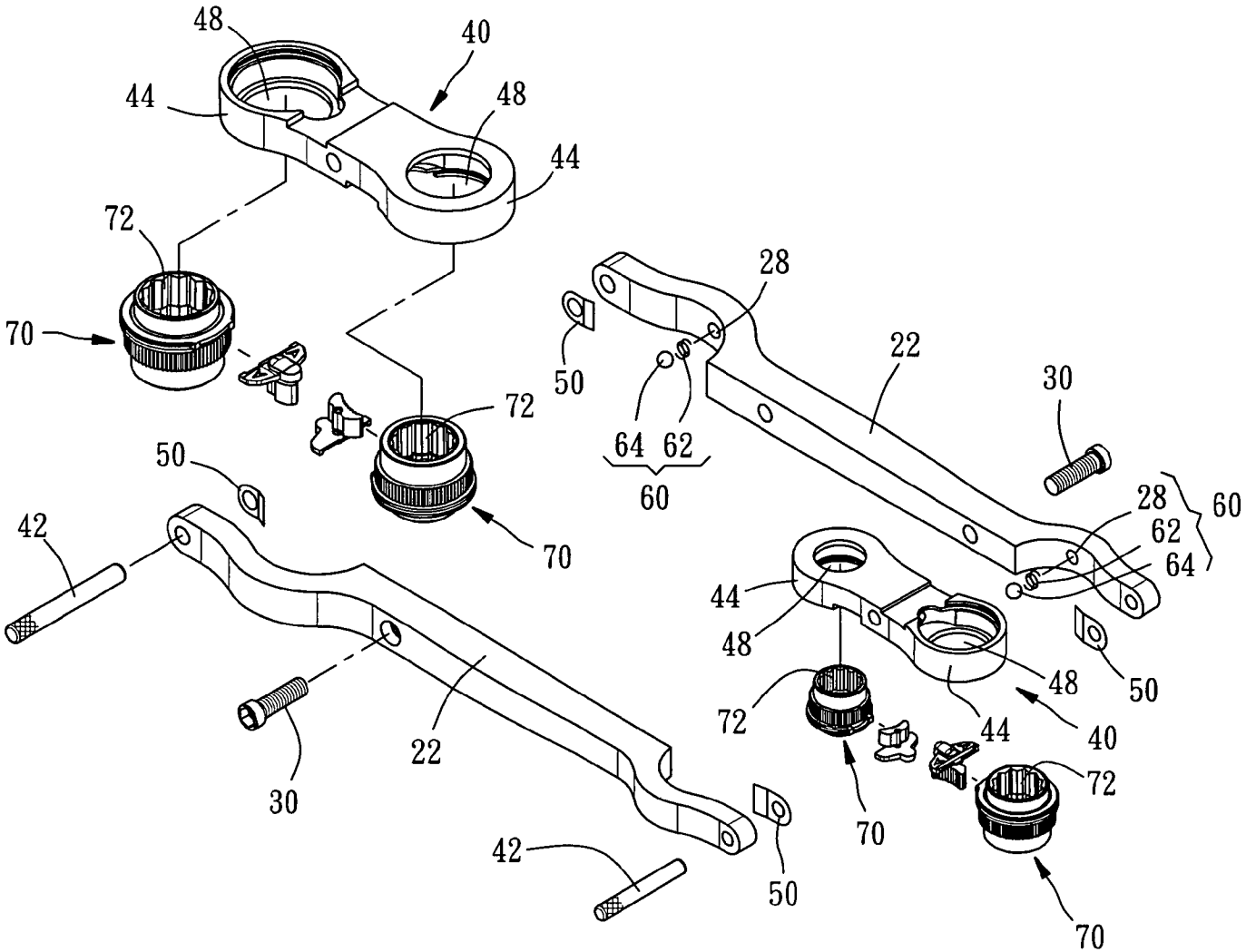
FIG. 2 is an exploded view of the wrench of the present invention.

As shown in FIGS. 1-2, a wrench, denoted with reference numeral 10, provided by a first preferred embodiment of the present invention comprises a handle 20, two adjustment screws 30, two working heads 40, four spring washers 50, two positioning units 60 and four ratchet sockets 70.

The handle 20 is constructed by two spaced rod members 22 in such a way that an opening 24 is formed at each of first and second ends of the handle 20 and a slot 26, which has two ends communicating with the openings 24 at first and second ends of the handle 20, is formed between the two rod members 22. It is to be noted that the first end means the end located at the left side of FIG. 1 and the second end is the end located at the right side of FIG. 1. In addition, one of the rod members 22 is provided at a lateral wall thereof with two receiving recesses 28 which are respectively located at the first and second ends thereof. For enabling the handle 20 to be gripped comfortably, on the body portion of the handle 20 a sleeve (not shown in the drawings) made from soft material such as plastic can be provided.

The adjustment screws 30 are respectively and inserted through the slot 26 from one of the rod members 22 into the other rod member 22. By means of tightening or loosening the screws 30, the gap of the slot 26, i.e. the distance between the rod members 26, can be adjusted. In other words, the width of the openings 24 at first and second ends of the handle 20 can be adjusted.

Referring to FIGS. 1-4, each of the two working heads 40, namely a first working head at the left side of FIG. 1 and a second working head at the right side of FIG. 1, is provided with two mounting portions 44, namely first and second mounting portions each having an indentation 46 at a lateral surface thereof and a mounting hole 48 through top and bottom surfaces thereof. In this embodiment, the sizes of all mounting holes 48 are different. In addition, each of the two working heads 40 is rotatably connected with one of the two ends of the handle 20 by a pivot shaft 42, namely a first pivot shaft at left side or a second pivot at right side, such that one of the first and second mounting portions 44 of the first working head can be selectively positioned in the opening 24 of the first end of the handle 20, and similarly one of the first and second mounting portions 44 of the second working head can be selectively positioned in the opening 24 of the second end of the handle 20.

The four spring washers 50 include two first spring washers respectively sleeved onto the first pivot shaft and stopped between the first end of the handle 20 and the first working head, and two second spring washers respectively sleeved onto the second pivot shaft and stopped between the second end of the handle 20 and the second working head, such that the spring washers 50 can provide a proper resistance on the working heads 40 respectively so as to slow down the revolution speed when the working heads 40 are rotated relative to the ends of the handle 20.

The positioning units 60 includes a first positioning unit provided at the first end of the handle 20 and a second positioning unit provided at the second end of the handle 20. More specifically speaking, the first positioning unit has a springing member 62 mounted in the receiving recess 28 of the first end of the handle 20, and a stopper 64, which is a steel ball in this embodiment, supported by the spring member 62 toward the first working head, such that the stopper 64 can be positioned in the indentation 46 of the one of the first and second mounting portions 44 of the first working head that is positioned in the opening 24 of the first end of the handle 20 for holding the first working head in position. Similarly, the second positioning unit has a springing member 62 mounted in the receiving recess 28 of the second end of the handle 20, and a stopper 64 supported by the spring member 62 toward the second working head, such that the stopper 64 can be positioned in the indentation 46 of the one of the first and second mounting portions 44 of the second working head that is positioned in the opening 24 of the second end of the handle 20 for holding the second working head in position.

Figure 3:
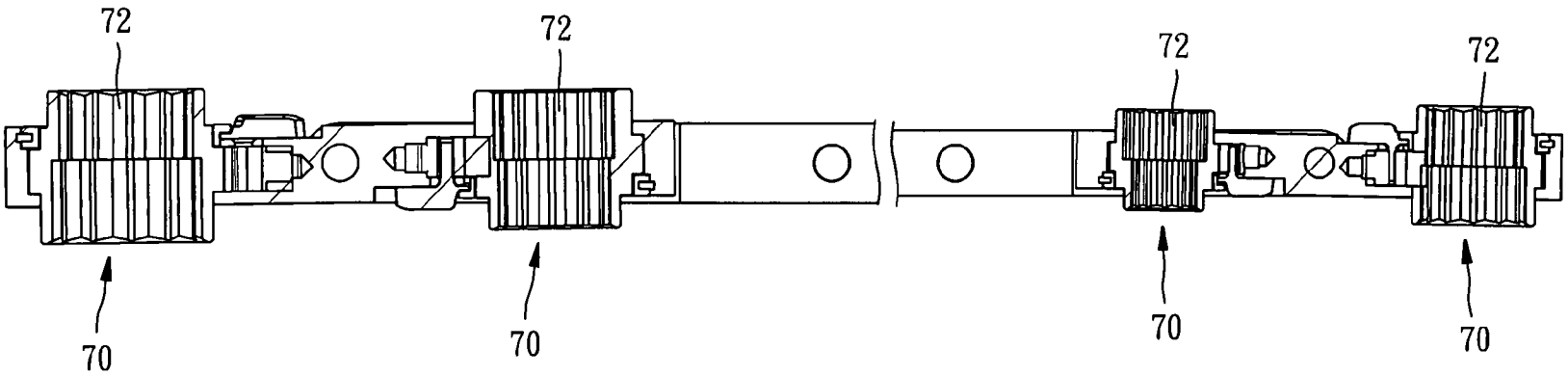
FIG. 3 is a sectional view of the wrench of the present invention.
Figure 4:
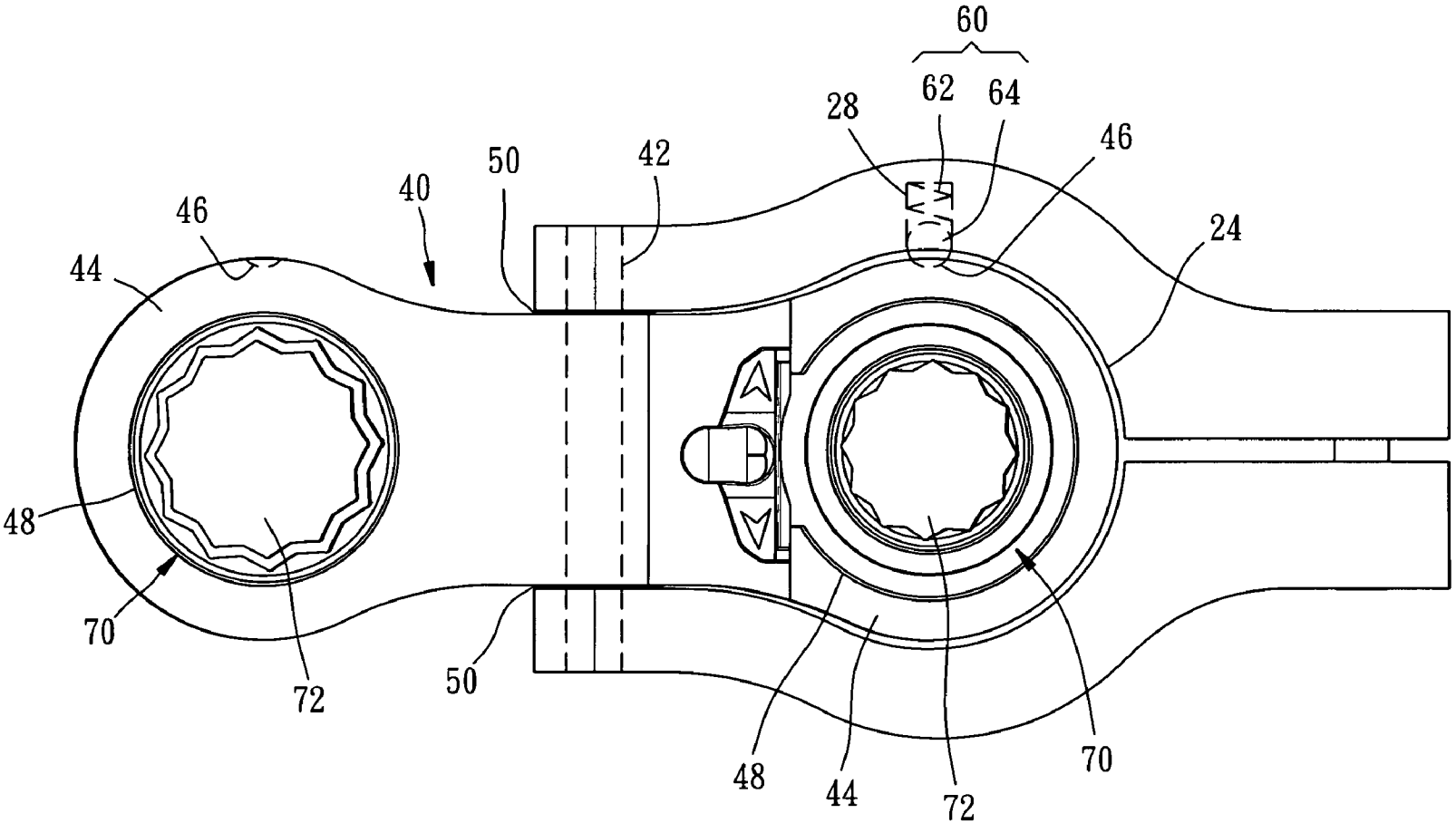
FIG. 4 is a top view of a part of the wrench of the present invention.
Figure 5:
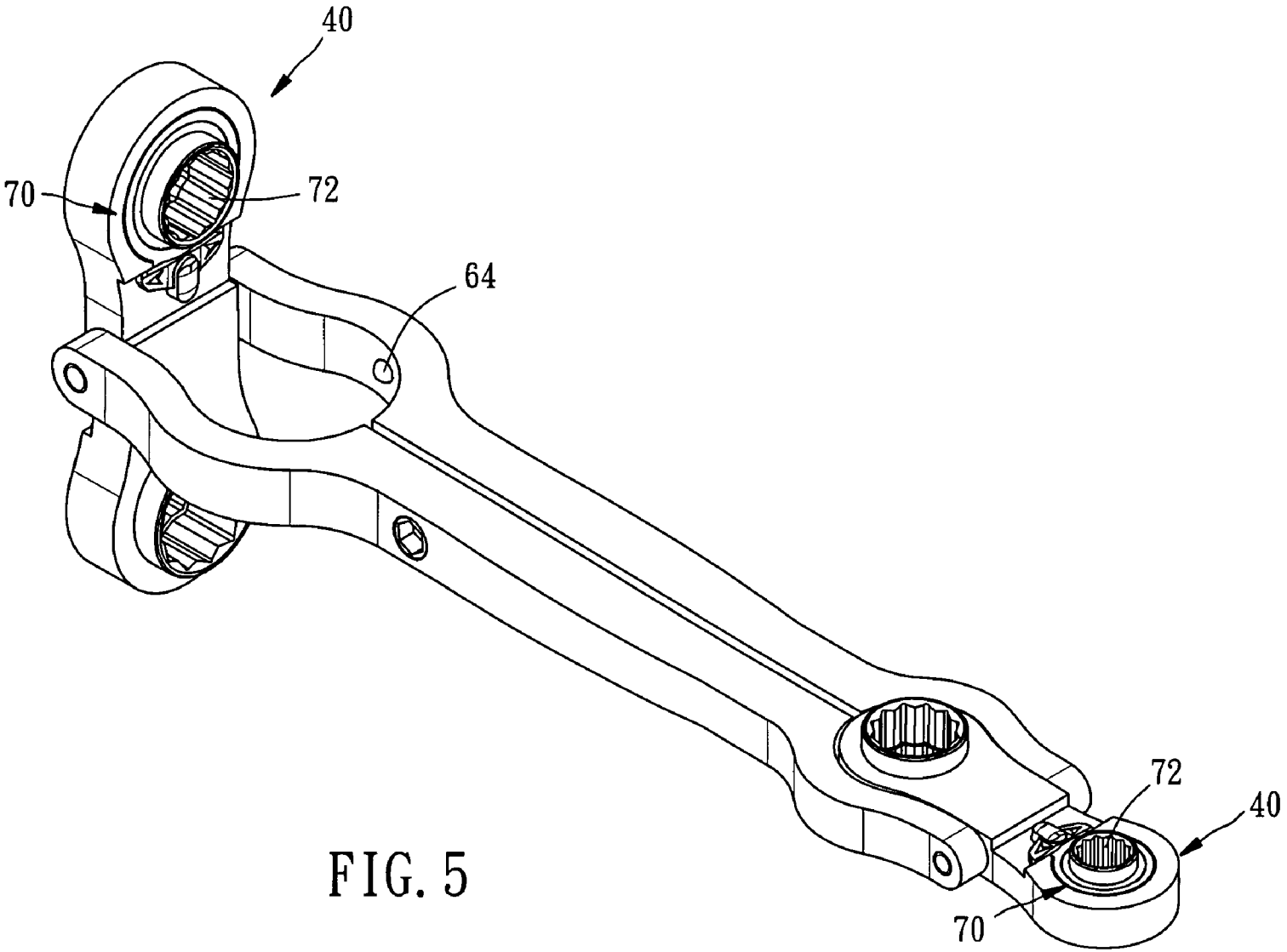
FIG. 5 is a perspective drawing showing an operation of the wrench of the present invention.

The ratchet sockets 70 are well known in the art; therefore, no detailed description thereof is necessary. The ratchet socket 70 includes first, second, third and fourth sockets which are respectively and rotatably mounted in the mounting holes 48 of the first and second mounting portions 44 of the first and second working heads, and each of ratchet sockets 70 has a stepped adaptor hole 72 having a relatively larger diameter portion and a relatively smaller diameter portion. In addition, the relatively larger diameter and smaller diameter portions of the adaptor holes 72 of the sockets 70 are different in size, as shown in FIG. 3, such that the wrench 10 of the present invention can fit eight different-sized nuts.

As indicated above, when the wrench 10 of the present invention is in use, it allows the user to select one of stepped adaptor holes 72 to match and then tighten or loosen a specific-sized nut by means of rotating the first or second working head 40. Since the spring washers 50 can provide a proper resistance to the working heads 40, they can prevent the working heads 40 from free rotation and regulate the revolution speed of the working heads 40 when the working heads 40 are forced to rotate. Besides, when the working head 40 is rotated to be coplanar with the handle 20, the stopper 64 of the positioning unit 60, which is pushed by the spring member 62, will be engaged into the indentation 46 of the working head 40 to hold the working head in a good position in the opening 24. Further, the user can use a hand tool, such as hex wrench, to tighten or loosen the two adjustment screws 30 so as to adjust the gap of the slot 26, i.e. adjusting the clamping force of the ends acting on the working heads 40. In other words, the rotationability of the working heads 40 relative to the ends of the handle 20 can be adjusted to a proper extent by the adjustment screws 30 or the cooperation of the spring washers 50 and the adjustment screws 30.

Figure 6:
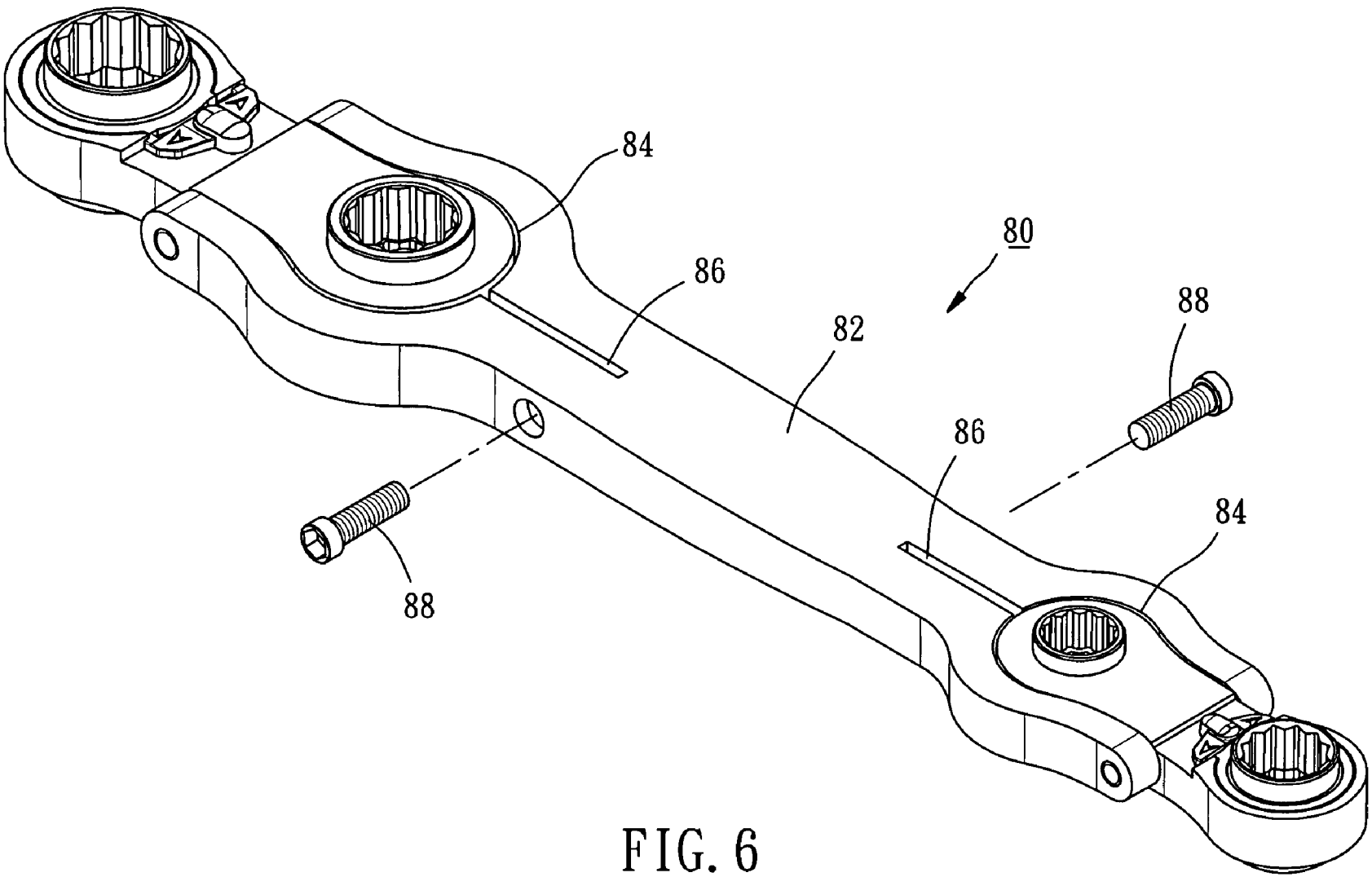
FIG. 6 is a perspective view of a wrench in accordance with a second preferred embodiment of the present invention.

FIG. 6 shows a wrench 80 according to a second preferred embodiment of the present invention. The wrench 80 has a structure mainly same as that of the wrench 10 of the first embodiment, in which the difference lies in that the handle 82 of the wrench 80 is made by a single piece, not by two spaced rod members. As shown in FIG. 6, the handle 82 has two slots 86 communicating with the openings 84 respectively, i.e. a first slot having an end communicating with the opening at the first end of the handle 82, and a second slot having an end communicating with the opening at the second end of the handle 82. In addition, the gaps of the first and second slots are adjustable by an adjustment screw 88 respectively, such that the wrench 80 can achieve the same function as the wrench 10 can.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A wrench for different-sized nuts, comprising:

a handle having an opening at a first end and a slot communicated with the opening;

an adjustment screw threadedly inserted into the handle and passing through the slot for adjusting a gap of the slot;

a first working head having a first mounting portion with a mounting hole and a second portion with a mounting hole, the first working head being rotatably connected with the first end of the handle such that one of the first and second mounting portions is selectively positionable in the opening of the first end of the handle;

a first ratchet socket rotatably mounted in the mounting hole of the first mounting portion of the first working head, and provided with an adaptor hole; and a second ratchet socket rotatably mounted in the mounting hole of the second mounting portion of the first working head, and provided with an adaptor hole which is different in size from the adaptor hole of the first ratchet socket.

2. The wrench as claimed in claim 1, wherein the handle comprises a second end that is opposite to the first end and provided with an opening and the slot of the handle is communicated with the openings of the first and second ends; the wrench further comprises:

a second working head having a first mounting portion with a mounting hole and a second mounting portion with a mounting hole, the second working head being rotatably connected with the second end of the handle such that one of the first and second mounting portions of the second working head is selectively positionable in the opening of the second end of the handle;

a third ratchet socket rotatably mounted in the mounting hole of the first mounting portion of the second working head, and provided with an adaptor hole; and a fourth ratchet socket rotatably mounted in the mounting hole of the second mounting portion of the second working head, and provided with an adaptor hole;

wherein the adaptor holes of the first, second, third and fourth ratchet sockets are different in size.

3. The wrench as claimed in claim 2, wherein the handle is constructed by two spaced rod members between which the openings and the slot are defined.

4. The wrench as claimed in claim 2, wherein each of the adaptor holes of the first, second, third and fourth ratchet sockets is a stepped hole having a relatively larger diameter portion and a relatively smaller diameter portion; the relatively larger diameter portions and relatively smaller diameter portions of the adaptor holes of the first, second, third and fourth ratchet sockets are different in size.

5. The wrench as claimed in claim 2, further comprising a first pivot shaft by which the first working head is rotatably connected with the first end of the handle, a first spring washer sleeved onto the first pivot shaft and stopped between the first end of the handle and the first working head, a second pivot shaft by which the second working head is rotatably connected with the second end of the handle, and a second spring washer sleeved onto the second pivot shaft and stopped between the second end of the handle and the second working head.

6. The wrench as claimed in claim 2, further comprising a first positioning unit and a second positioning unit; wherein the first positioning unit has a springing member mounted in a receiving recess of the first end of the handle, and a stopper supported by the spring member and locatable in an indentation of one of the first and second mounting portions of the first working head; wherein the second positioning unit has a springing member mounted in a receiving recess of the second end of the handle, and a stopper supported by the spring member of the second positioning unit and locatable in an indentation of one of the first and second mounting portions of the second working head.

7. The wrench as claimed in claim 1, wherein the handle further comprises a second end that is opposite to the first end and provided with an opening, a slot communicated with the opening of the second end, and an adjustment screw threadedly inserted into the handle and passing through the slot that communicates with the opening of the second end for adjusting a gap of the aforesaid slot;

the wrench further comprises:

a second working head having a first mounting portion with a mounting hole and a second mounting portion with a mounting hole, the second working head being rotatably connected with the second end of the handle such that one of the first and second mounting portions of the second working head is selectively positionable in the opening of the second end of the handle;

a third ratchet socket rotatably mounted in the mounting hole of the first mounting portion of the second working head, and provided with an adaptor hole; and a fourth ratchet socket rotatably mounted in the mounting hole of the second mounting portion of the second working head, and provided with an adaptor hole;

wherein the adaptor holes of the first, second, third and fourth ratchet sockets are different in size.

8. The wrench as claimed in claim 7, wherein each of the adaptor holes of the first, second, third and fourth ratchet sockets is a stepped hole having a relatively larger diameter portion and a relatively smaller diameter portion; the relatively larger diameter portions and relatively smaller diameter portions of the adaptor holes of the first, second, third and fourth ratchet sockets are different in size.

9. The wrench as claimed in claim 7, further comprising a first pivot shaft by which the first working head is rotatably connected with the first end of the handle, a first spring washer sleeved onto the first pivot shaft and stopped between the first end of the handle and the first working head, a second pivot shaft by which the second working head is rotatably connected with the second end of the handle, and a second spring washer sleeved onto the second pivot shaft and stopped between the second end of the handle and the second working head.

10. The wrench as claimed in claim 7, further comprising a first positioning unit and a second positioning unit; wherein the first positioning unit has a springing member mounted in a receiving recess of the first end of the handle, and a stopper supported by the spring member and locatable in an indentation of one of the first and second mounting portions of the first working head; wherein the second positioning unit has a springing member mounted in a receiving recess of the second end of the handle, and a stopper supported by the spring member of the second positioning unit and locatable in an indentation of one of the first and second mounting portions of the second working head.

* * * * *